US010789889B2

(12) United States Patent
Oulee et al.

(10) Patent No.: US 10,789,889 B2
(45) Date of Patent: Sep. 29, 2020

(54) SOURCE DRIVER MODULE, DISPLAY DEVICE AND METHOD FOR DRIVING A DISPLAY PANEL

(71) Applicant: Raydium Semiconductor Corporation, Hsinchu (TW)

(72) Inventors: Chi-Hsiang Oulee, Taitung (TW); Tzong-Yau Ku, Hsinchu (TW); Jun-Ren Shih, Hsinchu (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 0 days.

(21) Appl. No.: 16/296,421

(22) Filed: Mar. 8, 2019

(65) Prior Publication Data

US 2019/0279571 A1 Sep. 12, 2019

Related U.S. Application Data

(60) Provisional application No. 62/640,064, filed on Mar. 8, 2018.

(51) Int. Cl.
*G09G 3/3258* (2016.01)
*G09G 3/20* (2006.01)

(52) U.S. Cl.
CPC ..... *G09G 3/3258* (2013.01); *G09G 3/2088* (2013.01); *G09G 2310/027* (2013.01)

(58) Field of Classification Search
CPC .. G09G 3/2088; G09G 3/3258; G09G 3/3275; G09G 2310/027; G09G 2320/0223; G09G 2320/0233
See application file for complete search history.

(56) References Cited

U.S. PATENT DOCUMENTS

2016/0148599 A1* 5/2016 Lim ..... G09G 3/20 345/212

* cited by examiner

*Primary Examiner* — Stacy Khoo

(57) ABSTRACT

A source driver module, a display device and a method for driving a display panel are provided. The method for driving a display panel is applicable to the source driver module, which includes a source driver circuit, a first switch coupled between the source driver circuit and a first end of a first data line, and a second switch coupled between the source driver circuit and a second end of the first data line. The method for driving the display panel includes: when the display panel displays a first image, the source driver circuit outputs a first voltage signal to the first end of the first data line through the first switch, and when the display panel displays a second image after displaying the first image, the source driver circuit outputs a second voltage signal to the second end of the first data line through the second switch.

8 Claims, 7 Drawing Sheets

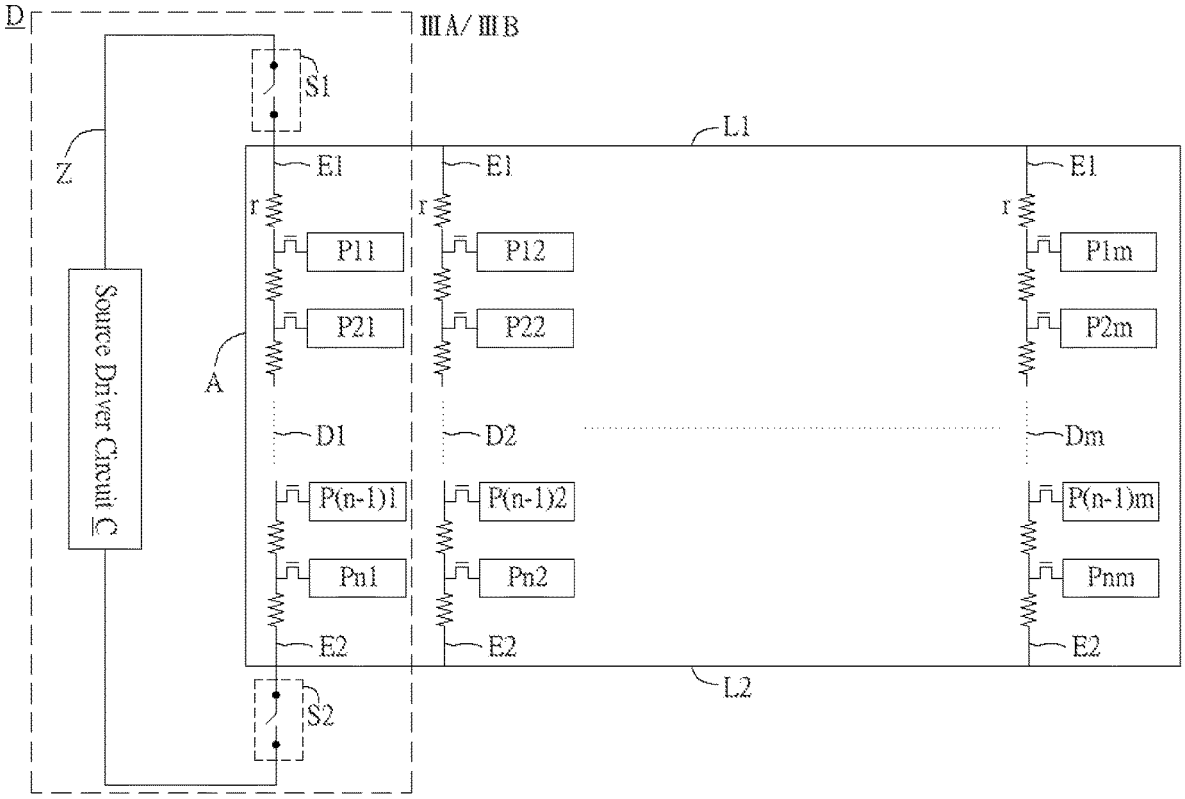
【FIG. 1】

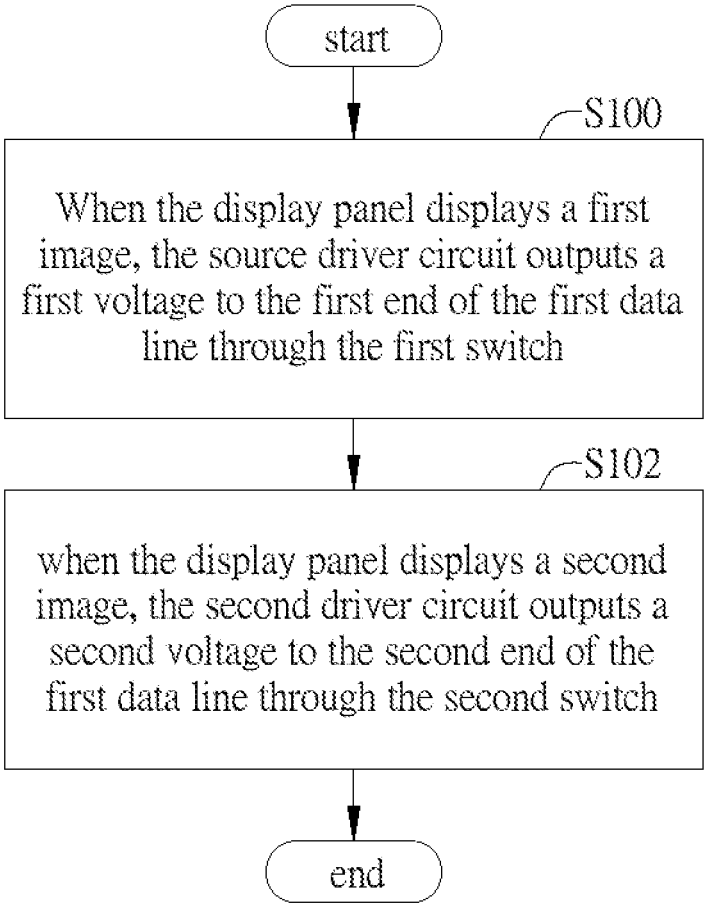
【FIG. 2】

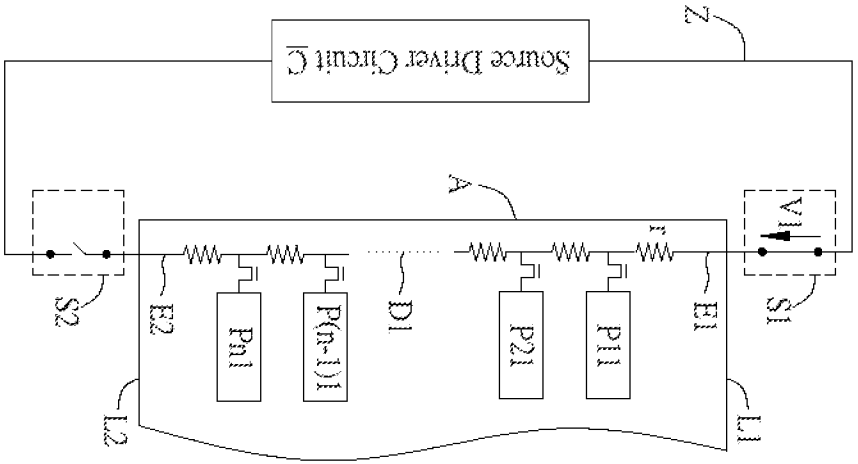
【FIG. 3A】
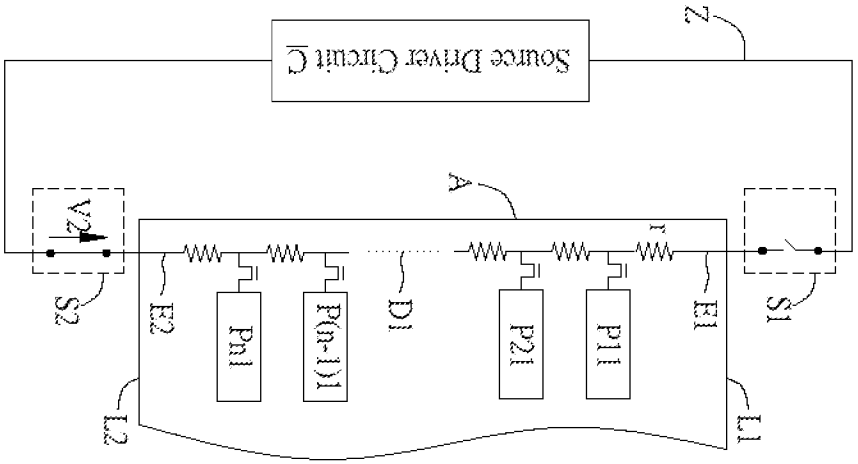
【FIG. 3B】

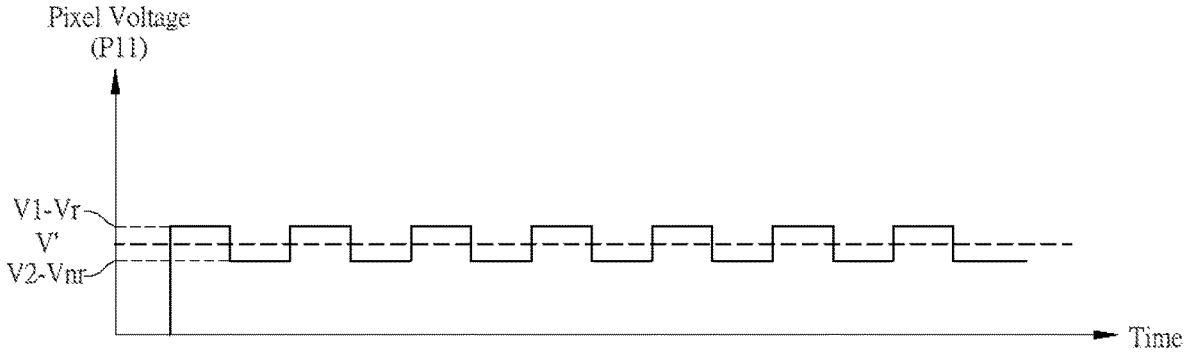
【FIG. 4】

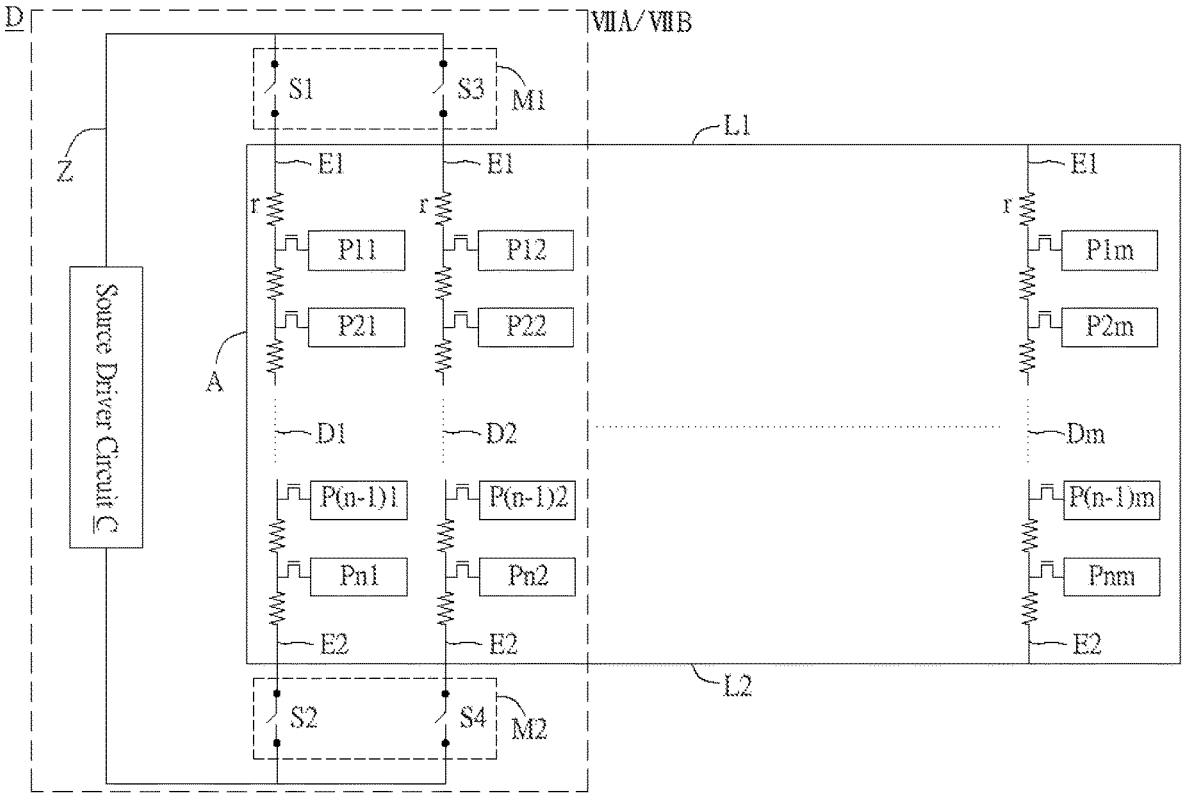
【FIG. 5】

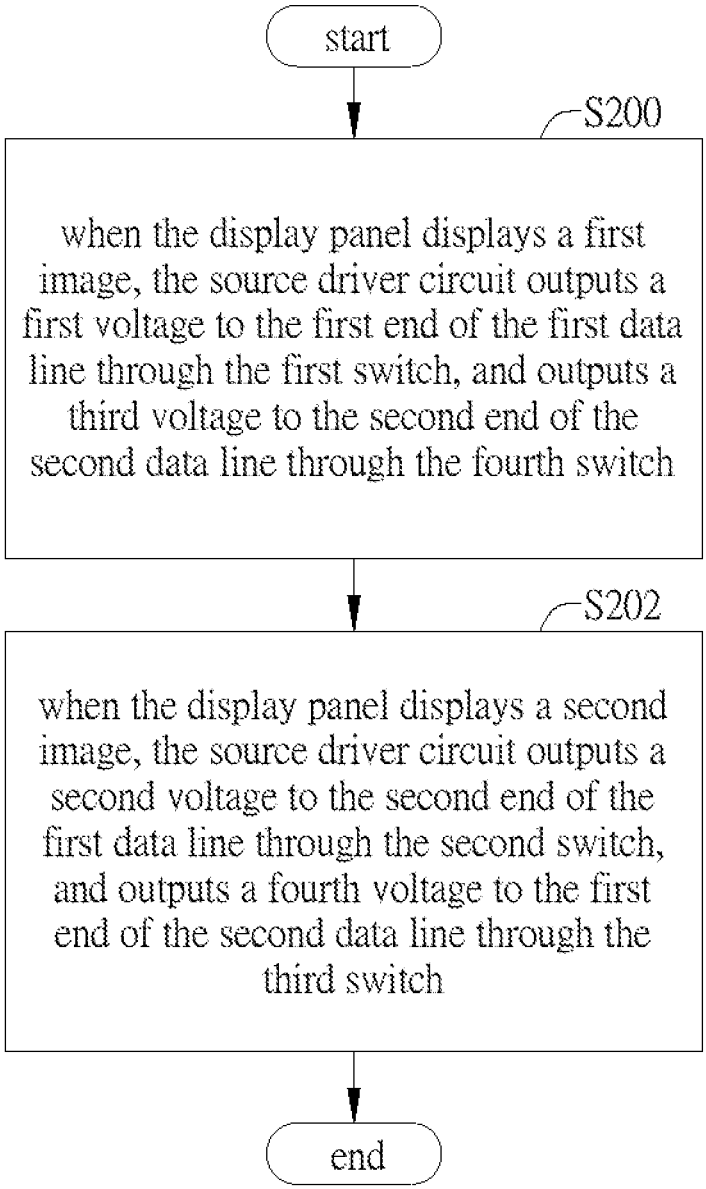
【FIG. 6】

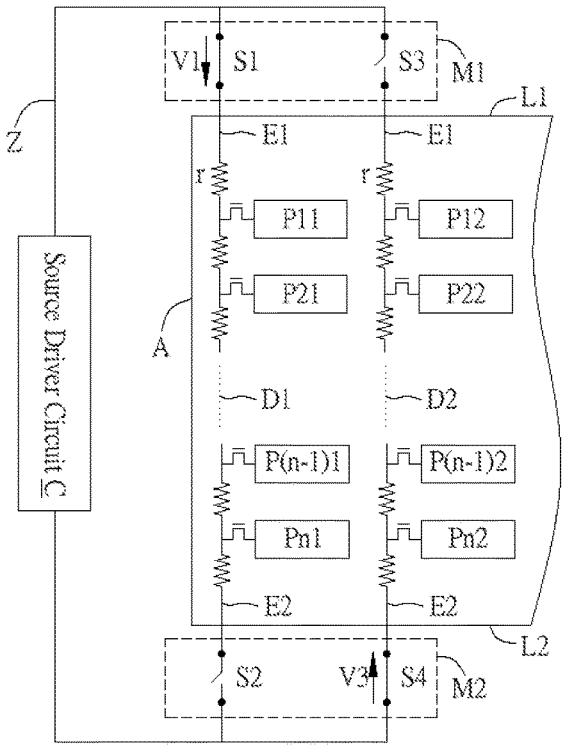
【FIG. 7A】
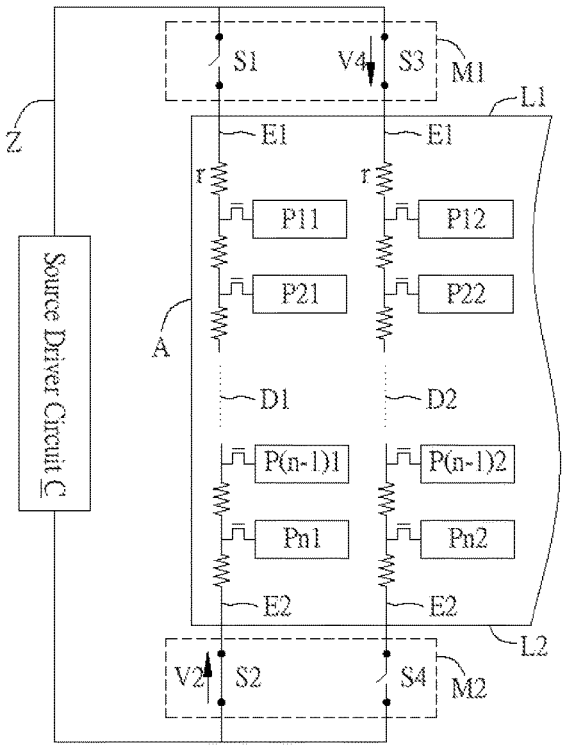
【FIG. 7B】

SOURCE DRIVER MODULE, DISPLAY DEVICE AND METHOD FOR DRIVING A DISPLAY PANEL

FIELD OF THE INVENTION

The present invention relates to a source driver module, a display device, and a method for driving a display panel. Specifically, the present invention relates to a source driver module, a display device, and a method for driving a display panel that increases the image uniformity of the display panel.

BACKGROUND OF THE INVENTION

Conventional source driver can be divided into two types according to the design of the trace thereof. One type of source driver is disposed on the upper end or the lower end of the display panel, and coupled to each data line through switch units. The source driver outputs pixel data to each data line according to a source signal generator.

Another type of source driver has traces connected to every two data lines through the upper end and the lower end of the display panel via switch units. Taking two adjacent data lines for example, one of the two data lines receives pixel data from the upper end of the display panel through a switch unit, and the other data line receives pixel data from the lower end of the display panel through another switch.

However, since the traces possess certain resistance, the pixel voltage signal transmitted through the traces to the data lines will not be the same as originally generated by the source signal generator. For instance, with respect to the first type of source driver mentioned above, when the source drivers are all disposed on the lower end of the display panel and output the same pixel voltage to all the pixels of the display panel, then the pixels closer to the lower end of the display panel will receive a pixel voltage higher than that received by the pixels closer to the upper end of the display panel. This is due to the larger resistance exhibited by the longer traces that the pixel voltage signals encounter when transmitted to the pixels closer to the upper end of the display panel.

On the other hand, when in the aforementioned second type of source driver, two pixels on the same horizontal level and respectively on two adjacent data lines receive the same pixel voltage signal, then the pixel receiving pixel voltages from the upper end of the display panel will receive a pixel voltage higher than the pixel receiving pixel voltages from the lower end of the display panel. This is because the pixel voltage transmitted through the lower end of the display panel goes through a relatively long data line, and therefore more voltage is consumed during the process, resulting in nonuniformity of brightness in the horizontal direction.

The aforementioned issues cause image nonuniformity; hence, conventional source drivers still have room for improvement.

SUMMARY OF THE INVENTION

In light of the above, one of the objectives of the present invention is to provide a source driver module, a display device, and a method for driving a display panel that reduce image nonuniformity by way of evening out voltage.

One embodiment of the present invention provides a source driver module used for driving a display panel. The source driver module comprises a source driver circuit, a first switch, and a second switch. The first switch is coupled between the source driver circuit and a first end of a first data line of the display panel. The second switch is coupled between the source driver circuit and a second end of the first data line of the display panel. The source driver circuit is used for outputting a first voltage signal to the first end of the first data line through the first switch when the display panel displays a first image, and outputting a second voltage signal to the second end of the first data line through the second switch when the display panel displays a second image after displaying the first image.

Another embodiment of the present invention provides a display device. The display device comprises a display panel and a source driver module coupled to the display panel. The source driver module comprises a source driver circuit, a first switch, and a second switch. The first switch is coupled between the source driver circuit and a first end of a first data line of the display panel. The second switch is coupled between the source driver circuit and a second end of the first data line of the display panel. The source driver circuit is used for outputting a first voltage signal to the first end of the first data line through the first switch when the display panel displays a first image, and outputting a second voltage signal to the second end of the first data line through the second switch when the display panel displays a second image after displaying the first image.

Another embodiment of the present invention provides a method for driving the above-mentioned display panel. The method includes: when the display panel displays the first image, the source driver circuit outputs the first voltage signal to the first end of the first data line through the first switch; and when the display panel displays the second image after displaying the first image, the source driver circuit outputs the second voltage signal to the second end of the first data line through the second switch.

To further understand the features and technical content of the present invention, please refer to the following detailed descriptions and drawings related to the present invention. However, the provided drawings are used only for providing reference and descriptions, and are not intended to limit the present invention.

BRIEF DESCRIPTION OF THE DRAWINGS

FIG. 1 shows the schematic view of a display device according to a first embodiment of the present invention.

FIG. 2 shows a flow chart illustrating a method for driving a display panel according to the first embodiment of the first invention.

FIG. 3A shows a schematic view illustrating step S100 of FIG. 2 being performed.

FIG. 3B shows a schematic view illustrating step S102 of FIG. 2 being performed.

FIG. 4 shows a voltage-time diagram of the pixel voltage received by the pixel unit P11.

FIG. 5 shows a display device according to a second embodiment of the present invention.

FIG. 6 shows a flow chart illustrating a method for driving a display panel according to the second embodiment of the present invention.

FIG. 7A shows a schematic view illustrating step S200 of FIG. 6 being performed.

FIG. 7B shows a schematic view illustrating step S202 of FIG. 6 being performed.

DETAILED DESCRIPTION OF THE PREFERRED EMBODIMENTS

Embodiments of the present invention are described below with reference to FIG. 1 to FIG. 7B. A person skilled in the art can understand the advantages and effects of the present invention from the description disclosed below. However, the content disclosed below is not intended to limit the protection scope of the present invention. The present invention can be implemented by a person skilled in the art based on different perspectives and applications without departing from the concept and spirit of the present invention. In addition, it should be stated in advance that the accompanying drawings of the present invention are merely used for illustration, and are not drawn according to actual dimensions for sake of clear illustration. Moreover, the same reference number corresponds to the same component. It should also be understood that expressions such as one component is "connected to" or "disposed on" another may mean that the former is either directly or indirectly connected to or disposed on the latter, wherein "connected" may refer to either physical or electrical connection.

First Embodiment

The first embodiment of the present invention is described below with reference to FIG. 1 to FIG. 4. The device of the present invention will be first explained, and then the description for the method applicable to the device follows. First of all, referring to FIG. 1, the first embodiment of the present invention provides a display device D having a source driver module Z and a display panel A. In the present embodiment, the display panel A can be an organic light-emitting panel, and the source driver module Z can be a ramp source driver. Moreover, the display device D can be made a silicon-based, that is, the display device D can be a Si-OLED. However, the present invention is not limited thereto. For example, in other embodiments, the display panel A can also be a thin film transistor display panel.

As shown in FIG. 1, the display panel A of the present invention includes a plurality of pixel units (P11, P22, . . . Pnm) arranged in an n by m matrix, in which each column of pixel units are connected in series by each being connected to a data line via a transistor. The source driver module Z further includes a source driver circuit C, a first switch S1 and a second switch S2. The first switch S1 is coupled between the source driver circuit C and the first end E1 of the first data line D1 of the display panel A. The second switch S2 is coupled between the source driver circuit C and the second end E2 of the first data line D1. The source driver circuit C is used for generating pixel voltage signals required for each pixel units (P11, P22, . . . Pnm), and outputting the pixel voltage signals to the first data line D1 through the first switch S1 or the second switch S2. The first switch S1 and the second switch S2 turn off to form a conductive path for the current to go through when the source driver circuit C outputs pixel voltages to the first data line D1. In practice, line buffers or buffers can be provided between the source driver circuit C and the first switch S1 and the second switch S2 so as to store and output voltage signals respectively. That is to say, the structure of the source driver module Z is not limited to the present embodiment.

Please refer to FIG. 2, FIG. 3A, and FIG. 3B, wherein FIG. 3A and FIG. 3B illustrate the partial schematic view of the portion of FIG. 2. The present embodiment provides a method for driving a display panel including at least step S100: when the display panel A displays the first image, the source driver circuit C outputs the first voltage signal V1 to the first end E1 of the first data line D1 through the first switch S1; and step S102: when the display panel A displays the second image after displaying the first image, the source driver circuit C outputs the second voltage signal V2 to the second end E2 of the first data line D1 through the second switch S2.

FIG. 3A corresponds to step S100, in which the display panel A displays the first image wherein the first switch S1 forms a conductive path so that the first voltage signal V1 is outputted to the first end E1 of the first data line D1. FIG. 3B corresponds to step S102, in which the display panel A displays the second image wherein the first switch S1 is opened and the second switch S2 is closed to form a conductive path so that the second voltage signal V2 is outputted the second end E2 of the first data line D1. For instance, the first voltage signal V1 and the second voltage signal V2 in FIG. 3A and FIG. 3B are generated by the source driver circuit C to be outputted to the pixel unit P11. After the first voltage signal V1 is outputted into the first data line D1, the voltage signal goes through the trace resistance r between the first end E1 and the pixel unit P11 before being received by the pixel unit P11. After the second voltage signal V2 is outputted into the first data line D1, the voltage signal goes through the n units of trace resistance r between the second end E2 and the pixel unit P11 before being received by the pixel unit P11.

Please refer to FIG. 4, which shows a voltage-time diagram of the pixel unit P11 of FIG. 3A and FIG. 3B. Specifically, when the first image is shown and the first voltage signal V1 is received by the pixel unit P11, the actual voltage value received by the pixel unit P11 is (V1−Vr) since the voltage signal goes through one unit of trace resistance r to get to the pixel unit P11, wherein Vr represents the voltage value consumed by one unit of trace resistance. When the second image is shown and the second voltage signal V2 is received by the pixel unit P11, the actual voltage value received by the pixel unit P11 is (V2−Vnr) since the voltage signal goes through n units of trace resistance r, wherein Vnr represents the voltage value consumed by n units of trace resistance. When performing step S100 and step S102 repeatedly and alternately for a period of time, the waveform of the voltage signal received by the pixel unit P11 can be shown as FIG. 4. Through the technical solution mentioned above, the pixel unit P11 displays the grey scale controlled by the average voltage V' of the highest voltage (V1−Vr) and the lowest voltage (V2−Vnr), thereby achieving evened out pixel voltage.

In the present embodiment, the problem of image non-uniformity of conventional display panels can be solved. More specifically, a pixel unit in a conventional display panel constantly receives pixel voltage from a certain end of each data line. For example, if a pixel unit is closer to the upper end of the display panel and all the pixel units in the display panel receive pixel voltages from the bottom of the display panel, then the pixel unit closer to the upper end of the display panel will receive a voltage smaller than those closer to the bottom of the display panel. Consequently, from a macro perspective, if all the pixel units on the same data line receive the same voltage, the displayed image will have a brighter upper part and a dimmer lower part along the direction of the data line. In the present embodiment, by providing a switch (S1, S2) to both ends (E1, E2) of the first data line D1 and outputting the pixel voltage signals to the pixel units (P11, P21 . . . Pn1) on the first data line D1 through the first end E1 and the second end E2 alternately, an evened out pixel voltage can be achieved, thereby alleviating the problem of brightness non-uniformity along the data line so that the pixel units (P11, P21 . . . Pn1) on the first data line D1 can output light of uniform brightness.

It should be understood that in the previous embodiment, only the first data line D1 is used to describe the technical solution of the present embodiment; however, the present invention is not limited thereto. In other embodiment, the aforementioned technical solution can be applied to all the data line (D1, D2 . . . Dm) of the display panel A, thereby enhancing the image uniformity of the display panel A.

Second Embodiment

The second embodiment of the present invention will be described below with reference to FIG. 5 to FIG. 7B. The main difference between the first embodiment and the second embodiment lies in: in the first embodiment, the pixel voltage is alternately outputted into the first end E1 and the second end E2 of a data line so as to alleviate the problem of bright non-uniformity along the data line; in the second embodiment, the pixel voltage is outputted to the data lines alternately through the first end E1 and the second end E2 along a direction perpendicular to the data lines so as to further reduce bright non-uniformity along the direction.

Specifically, referring to FIG. 5, the source driver module Z of the display device D of the present embodiment further includes a third switch S3 and a fourth switch S4. The third switch S3 is coupled between the first end E1 of the second data line D2 and the source driver circuit C, and the fourth switch S4 is coupled between the second end E2 of the second data line D2 and the source driver circuit C. As shown in the drawing, the first end E1 of the second data line D2 is on the first side L1 of the display panel A with the first end E1 of the first data line D1, and the second end E2 of the second data line D2 is on the second side L2 of the display panel A with the second end E2 of the first data line D1. The second side L2 is opposite the first side L1. In the present embodiment, the third switch S3 and the fourth switch S4 are used for a similar purpose as that of the first switch S1 and the second switch S2, in which the third switch S3 and the fourth switch S4 close whenever the source driver circuit C outputs pixel voltage to the second data line D2.

The method provided by the present embodiment is applicable to the display device D of FIG. 5, which will be described below with reference to FIG. 6, FIG. 7A and FIG. 7B. FIG. 7A and FIG. 7B respectively show the portion VIIA/VIIB of FIG. 5 at difference time points. The method for driving a display panel according to the second embodiment of the present invention includes at least step S200: when the display panel A displays a first image, the source driver circuit C outputs a first voltage signal V1 to the first end E1 of the first data line D1 through the first switch S1, and outputs a third voltage signal V3 to the second end E2 of the second data line D2 through the fourth switch S4; and step S202: when the display panel A displays a second image after displaying the first image, the source driver circuit C outputs a second voltage signal V2 to the second end E2 of the first data line D1 through the second switch S2, and outputs a fourth voltage signal V4 to the first end E1 of the second data line D2 through the third switch S3.

Specifically, FIG. 7A corresponds to step S200, wherein the display panel A displays the first image wherein the source driver circuit C outputs the first voltage signal V1 to the first data line D1 through the first switch S1 and outputs the third voltage signal V3 to the second data line D2 through the fourth switch S4. FIG. 7B corresponds to step S202, wherein the display panel A displays the second image wherein the source driver circuit C outputs the second voltage signal V2 to the first data line D1 through the second switch S2 and outputs the fourth voltage signal V4 to the second data line D2 through the third switch S3.

Through the technical solution mentioned above, the method of the present embodiment achieves at least the following effects. On the one hand, the first data line D1 and the second data line D2 display images with enhanced uniformity along the data line. Taking pixel unit P11 for example, when performing step S200 and step S202 repeatedly and alternately on the first data line D1, the pixel unit P11 will display the grey scale controlled by the average voltage of the highest voltage (V1−Vr) and the lowest voltage (V2−Vnr). Taking the pixel unit P12 for example, when performing step S200 and step S202 repeatedly and alternately, the pixel unit P12 will display the grey scale controlled by the average voltage of the highest voltage (V4-Vr) and the lowest voltage (V3−Vnr).

On the other hand, the present embodiment enhances the image uniformity along the direction perpendicular to eh data lines. For instance, if the source driver circuit C outputs the same voltage signal to the pixel unit P11 and the pixel unit P12 when displaying the first image and the second image, i.e. the first voltage signal V1, the second voltage signal V2, the third voltage signal V3 and the fourth voltage signal V4 are the same, although the pixel unit P11 and the pixel unit P12 displays light with brightness difference in the first image (the pixel unit P11 receives a voltage (V1−Vr) greater than the voltage (V3−Vnr) received by the pixel unit P12), the pixel unit P11 and the pixel unit P12 will display light of similar brightness since when displaying the second image, the brightness difference between the pixel unit P11 and the pixel unit P12 is compensated, in which the pixel unit P12 receives a voltage value (V4-V4) greater than the voltage value (V2−Vnr) received by the pixel unit P11. Therefore, when repeatedly performing step S200 and step S202, the pixel unit P11 and the pixel unit P12 will display light of similar brightness.

It is worth noting that the present invention is applicable to ramp source drivers. In general, in a display panel that uses a ramp source driver, the pixel voltages are inputted through the upper end and lower end of the display panel alternately so as to have a thinner bezel. For example, a first data line receives pixel voltage through the upper end, the second data line receives pixel voltage through the lower end, the third data line receives pixel voltage through the upper end . . . and so on. Based on the above-mentioned problem caused by trace resistance, image uniformity exists along the data line. Through the technical solution of the present embodiment, brightness difference between the pixel unit P11 and the pixel unit P12 within a frame of image is compensated after performing step S200 and step S202. This way, the problem of brightness non-uniformity along the data lines in conventional ramp source drivers can be solved.

In addition, in the present embodiment, the first switch S1 and the second switch S2 form the first multiplexer M1, and the second switch S2 and the fourth switch S4 form the second multiplexer M2. It should be understood that, although only the first data line D1 and the second data line D2 are used to describe the technical solution of the present invention, in other embodiments, multiplexers can also be provided at the first end E1 and the second end E2 of two adjacent data lines among other data lines (D3, D4 . . . Dm). In this way, the display panel A of the present embodiment can provide images of enhanced uniformity along the data lines and perpendicular to the data lines.

In summary, the source driver module Z, the display device D, and the method for driving a display panel provided by the embodiments of the present invention achieve enhanced image uniformity in the display panel A by the technical solutions of "when the display panel A displays the first image, the source driver circuit C outputs the first voltage signal V1 to the first end E1 of the first data line D1 through the first switch S1" and "when the display panel A displays the second image after displaying the first image, the source driver circuit C outputs the second voltage signal V2 to the second end E2 of the first data line D1 through the second switch S2".

The present invention has been described with reference to the above embodiments, but the above embodiments are merely examples for implementing the present invention. It should be noted that the disclosed embodiments are not intended to limit the scope of the present invention. On the contrary, any modification and equivalent configuration within the spirit and scope of the appended claims shall fall within the scope of the present invention.

What is claimed is:

1. A source driver module applicable to a display panel, the source driver module comprising:

a source driver circuit;

a first switch coupled between the source driver circuit and a first end of a first data line of the display panel; and a second switch coupled between the source driver circuit and a second end of the first data line of the display panel, wherein the source driver circuit is used for outputting a first voltage signal to the first end of the first data line through the first switch when the display panel displays a first image, and outputting a second voltage signal to the second end of the first data line through the second switch when the display panel displays a second image after displaying the first image.

2. The source driver circuit according to claim 1, further comprising:

a third switch coupled between the source driver circuit and a first end of a second data line of the display panel; and a fourth switch coupled between the source driver circuit and a second end of the second data line of the display panel, wherein the first end of the first data line and the first end of the second data line are on a first side of the display panel, and the second end of the first data line and the second end of the second data line are on a second side of the display panel opposite the first side, wherein the source driver circuit is used for outputting a third voltage to the second end of the second data line through the fourth switch when the display panel displays the first image, and outputting a fourth voltage signal to the first end of the second data line through the third switch when the display panel displays the second image after display the first image.

3. The source driver circuit according to claim 2, wherein the first data line and the second data line are arranged adjacent to each other.

4. The source driver circuit according to claim 3, further comprising a first multiplexer and a second multiplexer, the first multiplexer including the first switch and the third switch, and the second multiplexer including the second switch and the fourth switch.

5. The source driver circuit according to claim 1, wherein the source driver circuit is a ramp source driver.

6. A display device, comprising:

a display panel; and a source driver module coupled to the display panel, the source driver module including:

a source driver circuit;

a first switch coupled between the source driver circuit and a first end of a first data line of the display panel; and a second switch coupled between the source driver circuit and a second end of the first data line of the display panel, wherein the source driver circuit is used for outputting a first voltage signal to the first end of the first data line through the first switch when the display panel displays a first image, and outputting a second voltage signal to the second end of the first data line through the second switch when the display panel displays a second image after displaying the first image.

7. A method for driving a display panel, applicable to a display device comprising the display panel and a source driver, the source driver being coupled to the display panel and comprising a source driver circuit, a first switch and a second switch, the first switch being coupled between the source driver circuit and a first end of a first data line of the display panel, the second switch being coupled between the source driver circuit and a second end of the first data line of the display panel, the source driver circuit being used for outputting a first voltage signal to the first end of the first data line through the first switch when the display panel displays a first image, and outputting a second voltage signal to the second end of the first data line through the second switch when the display panel displays a second image after displaying the first image, the method comprising:

when the display panel displays the first image, the source driver circuit outputs the first voltage signal to the first end of the first data line through the first switch; and when the display panel displays the second image after displaying the first image, the source driver circuit outputs the second voltage signal to the second end of the first data line through the second switch.

8. The method according to claim 7, wherein the source driver further includes a third switch coupled between the source driver circuit and a first end of a second data line of the display panel, and a fourth switch coupled between the source driver circuit and a second end of the second data line, in which the first end of the first data line and the first end of the second data line are on a first side of the display panel, and the second end of the first data line and the second end of the second data line are on a second side of the display panel opposite the first side, the method further comprising:

when the display panel displays the first image, the source driver circuit outputs a third voltage signal to the second end of the second data line through the fourth switch; and when the display panel displays the second image after displaying the first image, the source driver circuit outputs a fourth voltage signal to the first end of the second data line through the third switch.

* * * * *